US012734422B2

(12) United States Patent
McCaleb

(10) Patent No.: US 12,734,422 B2
(45) Date of Patent: Sep. 15, 2026

(54) PORTABLE ARM MOVEMENT EXERCISE DEVICE UTILIZING CENTRIPETAL AND REACTIVE CENTRIFUGAL FORCE PRINCIPLES

(71) Applicant: Kyle David McCaleb, Lake Saint Louis, MO (US)

(72) Inventor: Kyle David McCaleb, Lake Saint Louis, MO (US)

( * ) Notice: Subject to any disclaimer, the term of this patent is extended or adjusted under 35 U.S.C. 154(b) by 0 days.

(21) Appl. No.: 18/241,991

(22) Filed: Sep. 4, 2023

(65) Prior Publication Data

US 2023/0415013 A1 Dec. 28, 2023

Related U.S. Application Data

(63) Continuation of application No. 17/393,319, filed on Aug. 3, 2021, now Pat. No. 11,745,071, which is a continuation of application No. 16/405,973, filed on May 7, 2019, now Pat. No. 11,077,347, which is a continuation of application No. 13/043,283, filed on Mar. 8, 2011, now Pat. No. 10,279,236.

(60) Provisional application No. 61/311,688, filed on Mar. 8, 2010.

(51) Int. Cl.

| | |
|---|---|
| ***A63B 69/00*** | (2006.01) |
| ***A63B 21/00*** | (2006.01) |
| ***A63B 21/06*** | (2006.01) |

(52) U.S. Cl.

CPC .... *A63B 69/0002* (2013.01); *A63B 21/00043* (2013.01); *A63B 21/0608* (2013.01); *A63B 2069/0006* (2013.01); *A63B 2209/00* (2013.01)

(58) Field of Classification Search

CPC ..... A63B 21/00043; A63B 21/0608; A63B 69/0002; A63B 69/0091; A63B 2069/00

See application file for complete search history.

(56) References Cited

U.S. PATENT DOCUMENTS

| | | | | | |
|---|---|---|---|---|---|
| 1,333,005 | A | * | 3/1920 | Warner | A63B 23/16 482/110 |
| 3,342,482 | A | * | 9/1967 | Paolone | A63B 21/0608 473/576 |
| 3,637,205 | A | * | 1/1972 | Bankston | A63B 21/012 84/477 B |
| 3,942,790 | A | * | 3/1976 | Rice | A63B 21/012 482/131 |
| 4,865,316 | A | * | 9/1989 | Yeaman | A63B 21/00043 482/126 |

(Continued)

*Primary Examiner* — Zachary T Moore

(74) *Attorney, Agent, or Firm* — William S. Parks

(57) ABSTRACT

A device to strengthen a person's arm muscles through the utilization of a portable device including a handle portion and a weight component with the two components separated by a flexible rod is provided. Such a device allows for the user to grip the handle portion and act as if they are throwing such a handle portion while the weight end moves along an arc defined through the length of the flexible rod. The resultant action is the generation of centripetal force along the defined arc with the reactive centrifugal force providing resistance to the user's arm muscles in a manner that is unique and heretofore unattainable through the utilization of a portable exercise device. The flexible rod component provides at least 1 foot (100 cm) of spacing between the handle portion and the weight portion.

3 Claims, 3 Drawing Sheets

(56) References Cited

U.S. PATENT DOCUMENTS

| | | | | | |
|---|---|---|---|---|---|
| 5,230,506 | A * | 7/1993 | Cipriano | A63B 69/0091 | 473/424 |
| 5,393,284 | A * | 2/1995 | Wesley | A63B 21/072 | 482/106 |
| 5,492,321 | A * | 2/1996 | Cipriano | A63B 69/0002 | 473/424 |
| 5,891,003 | A * | 4/1999 | Deac | A63B 5/16 | 482/106 |
| 5,897,469 | A * | 4/1999 | Yalch | A63B 21/0602 | 482/109 |
| 6,322,460 | B1 * | 11/2001 | Asci | A63B 69/0002 | 24/114.5 |
| 6,695,671 | B2 * | 2/2004 | Kessler | A63B 5/22 | 482/81 |
| 11,077,347 | B2 * | 8/2021 | McCaleb | A63B 21/0608 | |
| 11,534,660 | B2 * | 12/2022 | Alba | A63B 24/0062 | |
| 11,707,660 | B1 * | 7/2023 | Smith | A63B 69/0002 | 473/139 |
| 2004/0082449 | A1 * | 4/2004 | Brown, Jr. | A63B 23/0211 | 482/140 |
| 2004/0242387 | A1 * | 12/2004 | Benach | A63B 21/00043 | 482/121 |
| 2007/0037637 | A1 * | 2/2007 | Jennings | A63B 69/0002 | 473/424 |
| 2007/0135275 | A1 * | 6/2007 | Oates | A63B 21/0004 | 482/109 |
| 2010/0009822 | A1 * | 1/2010 | Holleman | A63B 21/4035 | 482/126 |
| 2010/0120591 | A1 * | 5/2010 | Shaterian | A61H 15/0092 | 482/106 |

* cited by examiner

PORTABLE ARM MOVEMENT EXERCISE DEVICE UTILIZING CENTRIPETAL AND REACTIVE CENTRIFUGAL FORCE PRINCIPLES

CROSS-REFERENCE TO RELATED APPLICATIONS

This application is a Continuation of copending U.S. patent application Ser. No. 17/393,319, filed on Aug. 3, 2021, which is a Continuation of U.S. patent application Ser. No. 16/405,973, filed on May 7, 2019, now U.S. Pat. No. 11,077,347, which is a Continuation of U.S. patent application Ser. No. 13/043,283, filed on Mar. 8, 2011, now U.S. Pat. No. 10,279,236, which claims priority to U.S. Provisional Patent Application No. 61/311,688, filed on Mar. 8, 2010. The entireties of all of the great-grandparent, grandparent, parent, and earlier provisional applications are herein incorporated by reference.

FIELD OF THE INVENTION

This invention pertains to a device to strengthen a person's arm muscles through the utilization of a portable device including a handle portion and a weight component with the two components separated by a flexible rod. Such a device allows for the user to grip the handle portion and act as if they are throwing such a handle portion while the weight end moves along an arc defined through the length of the flexible rod. The resultant action is the generation of centripetal force along the defined arc with the reactive centrifugal force providing resistance to the user's arm muscles in a manner that is unique and heretofore unattainable through the utilization of a portable exercise device. The flexible rod component provides at least 10 inches (254 cm) of spacing between the handle portion (which may be in the form of a sphere, such as a baseball or softball, or a handle, or any other typical implement that a person may throw or swing) and the weight portion (which may be of any configuration to permit increase or decrease of the weight present thereon).

BACKGROUND OF THE INVENTION

Training devices for muscle toning and/or developing, particularly for arm and shoulder muscles, have been provided in the past to varying degrees and myriad configurations. A plethora of such devices are stationary and unable to be easily transported by the user from one location to another. As such, these devices typically engender a weight system attached to a lifting mechanism provided within a rather large and bulky overall system. As well, other devices employ elastic cords and the like to provide resistance to a ball or like grip portion while a user moves the same in a pitching motion. Such devices, as well, do not include any manner of compensating for phenomena such as arc movement and centripetal forces as the stationary systems require a repetitive range of motions that rely upon the stationary basis of the device itself.

Over devices have allowed for free ranges of motions through their portability; however, such devices as well are limited in their allowance of the overall range of potential arc motions that are permitted. For instance, U.S. Pat. No. 5,092,588, to DeLuca, provides a training device including a baseball gripping portion and an extension therefrom including a hammer component to allow for the user to act as if a ball is being thrown (without releasing such) and maneuvering the overall device to permit the arm muscles of the user to stress and resist in a unique pattern attuned to the movement of the hammer portion in relation to the user's arm movement. Such a device, however, is limited by the rigidity of the extension as well as the relatively short length of such an extension, thereby limiting the overall effect available for the user. Like devices have been proposed utilizing differing extensions (such as liquid containers, thereby permitting a different degree of momentum and torque on the throwing arm during use), but still relying upon a short, inflexible extension arm at best (such as, at most 2 inches, or 5.08 centimeters, in length from the ball or grip portion to the weight portion. Yet other devices accord a user the ability to swing a bat or racket with movable weights to different distances from the end point of the grip portion, but including a large and rigid extension portion between the grip and the weights. Such limited devices thus evince drawbacks as the possible muscle treatments that are available through their utilization. To the contrary, the inventive device provides a unique and novel manner of toning and developing a user's arm and shoulder muscles through a greater degree of centripetal (and reactive centrifugal) forces. To date, no other device in the industry allows for the same level of muscle treatments.

Advantages and Description of the Invention

Thus, one distinct advantage of the inventive device is the ability to provide high torque levels during use through throwing motions in order to provide stresses and resistance to arm and shoulder muscles to a degree and in a manner that has not been provided through typical devices in the past. As well, another advantage of the inventive device is the capability of adjusting the grip portion to any desired type that is compatible with a user's own hand as well as the ability to adjust the type and overall configuration of the weight portion of such a training device on demand. An additional advantage of the inventive device is the increased torque on the user's muscles provided by the flexibility of the extension present between the grip and weight portions thereof at a minimum distance of 10 inches (25.4 centimeters). Furthermore, yet another advantage of the inventive device is the ability to transport such a device anywhere desired within a typical container for baseball (and other sport types) paraphernalia (such as a gym bag) and, if desired, the utilization of a telescoping flexible extension to allow for ease in transport as well as variability in overall available centripetal force generation on demand.

Accordingly, the invention encompasses an athletic training device including a grip portion of a suitable size and shape to allow a user to properly handle such a portion and implement a throwing motion thereof without releasing such a portion after such throwing motion has completed, a weight portion, and a flexible extension portion having a first end and a second end, wherein said flexible extension portion includes means for securely and releasably retaining said grip portion thereto at said first end and means for securely and releasably retaining said weight portion at said second end, wherein said flexible extension portion is a substantially straight rod that exhibits a maximum degree of flexural modulus of 750 mPa, and wherein the length of said flexible extension is from at least 10 inches (254 centimeters) to 3 feet (914.4 centimeters), and wherein said portion provides a weight of from 1.0 ounce (28.4 grams) to 40 ounces (1.13 kilograms). A method of athletic training utilizing the inventive device is encompassed within this invention as well.

In essence, the inventive device allows for muscle treatment through the generation of centripetal and reactive centrifugal forces through an exaggerated throwing motion, thus developing arm strength and flexibility while minimizing stress to the targeted muscle groups. The basic elements of the device are, as alluded to above, a flexible shaft of any length from about 10 inches to 3 feet and of any peripheral configuration (preferably cylindrical in shape, but a rhombus, triangle, or other geometric shape along the shaft axis may be utilized as well) and exhibiting a flexural modulus of at most 750 mPa provides the base component. Such a shaft (or rod, as an alternative description) is preferably a two-sided metal component with threads on either end or may be made from a flexible polymer (such as compressed nylon, polycarbonate, polyacrylic, polypropylene, high molecular weight polyethylene, and the like; the flexibility limitation is the determinative requirement, in essence) and having a diameter (or substantially uniform thickness along a standard axis, should a non-cylindrical shaft component be utilized) and including threaded ends to permit the introduction of a bolt or like attachment means. In such a manner, the ends of the shaft component may include the threaded portions integrated therein or, with flexible polymer types, may include metal caps that are permanently secured therein without possibility of disengagement without destruction to the overall structure of the shaft itself, wherein such metal caps further include suitable threaded portions of complementary depths and diameters to bolts as noted above. Thus, the flexible shaft components provide the potential for the user to secure the ends with suitable bolts or other locking means of complementary shape and size to such threaded portions. Such shafts, having two like ends of substantially similar diameters (or thicknesses), are thus to be introduced within the other two essential components of the inventive device, one being a grip portion that a user will be able to handle and maneuver in a throwing motion, and the other being a weight portion.

The grip portion may be any suitable shape or size implement that allows a user proper handling thereof and, as well, permit's the user to actually enact a throwing or swinging motion while handling such an implement and, preferably, without releasing such implement prior to, during, and subsequent to a throwing or swinging motion. Thus, the grip portion may be of any shape or configuration that meets such a requirement, including a sphere (including, baseballs, tennis balls, softballs, lacrosse balls, basically any sphere that may be gripped by a user), a closed loop handle, an open loop handle, a racket handle, and a football. The necessity, again, of such a grip portion is the ability of user to actually handle and accord a throwing or swinging motion thereto while the grip portion is attached to the flexible shaft. As well, the attachment of the grip portion to the flexible shaft is provided through the proper introduction of one end of the shaft through an opening or tunnel within the grip portion implement. A sphere will thus require a proper drilled opening straight through one side of the sphere, through the middle thereof and out the opposite side. The shaft should fit snugly therein the opening and/or tunnel such that little or no rotational movement of the grip portion should occur upon proper attachment through locking means securing the grip portion to the shaft. Additionally, a soft support structure should be employed on the shaft and present at the end opposite that to which the locking means (such as a bolt tightened within the threaded portion of the target shaft end to which the grip portion is introduced) attached. Such a support structure, such as a neoprene, styrene-butadiene, nitrile butadiene, or other like elastomeric material, is applied in relation to the opening in the grip portion that resides at that specific location. The support structure is of a diameter in excess of the shaft as well as the grip portion opening and is secured permanently to the shaft itself at that location. In such a manner, the grip portion will be held in place by both the support structure and the locking means to prevent unwanted movement along the length of the shaft during use. The soft material also aids in reducing any discomfort to the user during actual use of the device, particularly upon repetitive and/or oscillating movements of throwing motions. Spherical grip portions may be standard baseballs and softballs with the middle drilled through, as noted above, but with the outer portions intact for utilization as a throwing implement. The locking means may be a bolt that complements the threads of the flexible shaft and is properly recessed within the body of the grip portion to alleviate any possible discomfort or exaggerations in throwing for the user.

The grip portion, though, may be, as described above, any implement that may be attached to the flexible shaft through a suitable locking means in relation to the threaded ends and that accords the user the ability to enact a throwing or swinging motion as well. A closed handle may be employed with the shaft attached to the bottom edge of such a handle; an open handle with an attachment to a lower edge (and with the open end being a side portion thereof) may be utilized as well. A football-shaped implement or racket handle implement are other potential grip portion types for thus purpose as well.

The shaft, as noted above, is attached at its other end in a like manner to the grip portion as to a weight portion. Similar locking means would be utilized for end attachment thereto and the shaft may be introduced through the body of such a weight portion as for the grip portion for such a purpose. In actuality, the weight portion may be another sphere (of like or dissimilar size and weight to the grip portion, depending on the desires of the user) and the overall device may appear as a dumbbell-shaped apparatus with two spheres present on opposite ends thereof, although the device is not used as a weightlifting implement. The user may, in such an instance, switch being either end in terms choosing to exercise his or her throwing motion if two spherical ends are present. Otherwise, the device may utilize a sphere of different material from the grip portion sphere (and possibly of a configuration that removes portions thereof to accommodate different weights without removing and replacing the entire weight portion from the shaft itself). Likewise, the weight portion may be actual weights present thereon and attached either rigidly or in a manner that allows such weights to move up and down the shaft to the support structure present on the weight portion end thereof, in order to accord varying weight distributions on demand during use. Furthermore, a liquid container including varying levels of liquid may be utilized to accord similar weight distribution and inertia differences during use, if desired. Any number of possible scenarios are within the scope of the inventive device in terms of the weight portion present on one end of the flexible shaft itself. The important issue is the length of the shaft and the flexibility thereof that ultimately accords, during exercise and use thereof in the aforementioned throwing or swinging motion, exaggerated levels of torque to the user's arm and shoulder muscles to develop and flex such groups, while minimizing the overall stress on the joints, ligaments, and tendons in the same vicinity.

Additionally, then, since the user may be of any height and build, the overall length of the flexible shaft, allows for targeted levels of centripetal and reactive centrifugal forces to be generated on demand, particularly in relation to the weight present on that end of the flexible shaft during use. With a maximum weight of about 40 ounces generally considered proper to provide the best overall workout for a user in this type of activity, as well as to reduce any propensity for possible injuries to the user, or the possibility of harm to passersby during utilization, the length of the flexible shaft is of great importance to provide the targeted end results. A minimum length of 10 inches is required for the overall length of the shaft itself (and thus the overall length of the entire device, for the most part) in order to accord such desired and targeted muscle development and flexibility, with the maximum about 3 feet. Too long a device will result in difficulty for the user in actuality maneuvering the device without injuring himself or herself during use. Certainly, though, the taller the user, the longer the device may be to accord the user maximum benefit therefrom.

The device may be provided with multiple grip portions and weight portions, if desired. As well, differing flexible shaft portions may be provided to adjust the lengths thereof on demand. However, the device may also include a telescoping feature of the flexible shaft that allows for the user to set the length as desired with a compression nut (or like means). A two-part shaft component may be utilized in such a manner to allow for an inner, narrower diameter shaft component to nest and slide within a wider shaft component to nearly double the length of the narrower component itself upon full movement of the narrower shaft component to the extent it may exit the wider shaft component. The two shaft components would include stopping means to prevent removal of the narrower shaft component therefrom the wider shaft component (such as complementary end caps of metal or like strong material). In such a manner, again, the user may set the length of the flexible shaft portion to any length possible from that provided with such a telescoping component with every reliance on its stability during use to remain at the set length. Alternatively, though, the user may not set the locking means in place, thus allowing for the flexible shaft to move during use, thus imparting yet another manner of exercising the targeted muscle groups in a different fashion.

The device requires no one other than the athlete to use. It remains secure in the athlete's hand during use, thereby allowing a fast-paced, repetitive workout. By reducing the typical levels of strain generated from rapid acceleration and deceleration characteristics of pitching, this device is ideal for rehabilitation purposes. The device is portable, need not be tethered to any grounding surface, and can be used safely and easily both indoors and outdoors. This device is relatively simple in design, yet economical to manufacture and use.

DETAILED DESCRIPTION OF THE PREFERRED EMBODIMENTS

Figure 1:
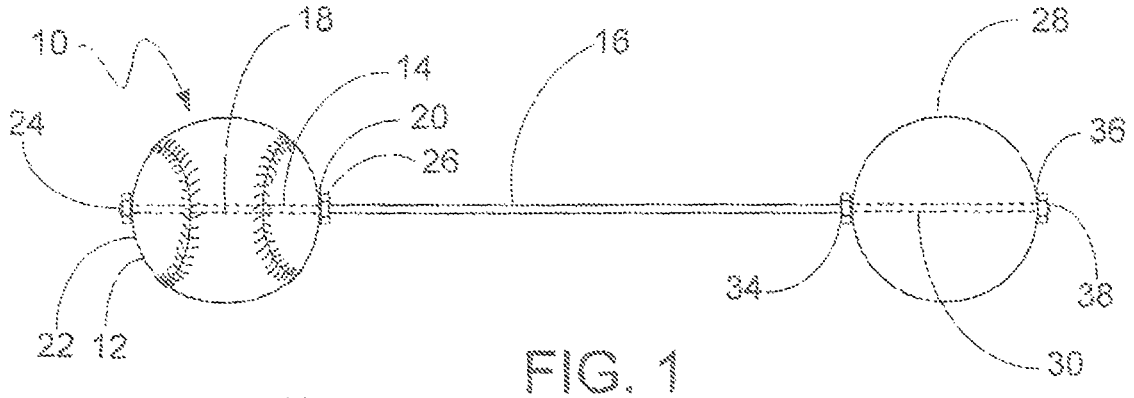
FIG. 1 is a side view of one embodiment of the inventive device utilizing a baseball-shaped handle portion and a spherical weight portion.

The invention is best explained through the following drawings showing potentially preferred embodiments of the inventive device. In no way are such depictions intended to limit the scope of the device itself as the ordinarily skilled artisan should understand suitable alternatives thereto that fall within the breadth of the overall invention without having to provide every possible permutation thereof within this description.

As noted above, FIG. 1 shows a side view of the overall device 10 including a spherical grip portion 12 (here a regulation size baseball) through which a first end 14 of a flexible rod 16 (here shown at an overall length of 18 inches, or about 45 centimeters) is present within a tunnel 18 created therein with an inner opening 20 and an outer opening 22. The flexible rod 16 is cylindrical in shape in this instance with a diameter of 1 inch (2.54 centimeters) and is made of compressed nylon strands to provide a suitable flexural modulus to permit the rod 16 to flex during application of torque through a throwing motion, as described below. A bolt 24 secures the sphere 12 onto the first 14 through screwing into a threaded portion (not illustrated) of the flexible rod 16. A soft support structure 26 is present just outside of the inner opening 20 of the sphere 12 and is permanently attached to the flexible rod 16 at that exact location in order to provide support to the grip portion 12 and, in conjunction with the bolt 24, prevent any appreciable movement of the sphere 12 around the axis of the flexible rod 16 during use. As well, the support structure 26, prevents further movement of the sphere 12 inwardly along the axis of the flexible rod 16, thus retaining the spherical grip portion 12 in place at the first end 14 of the rod 16. A weight portion 28 (here, a second sphere, which may also act as a grip portion with the other sphere acting as the weight portion, being a regulation-size softball for male hitters) is present on a second end 30 of the flexible rod 16. A tunnel 32 is present on this weight portion 28 as well to allow for the rod 16 to enter and exit the spherical weight 28 in the same manner as that for the spherical grip portion 12 through an inner opening 34 and an outer opening 36. A bolt 38 provides a secure and releasable attachment of the weight portion 28 to the rod 16 at the outer opening 36, and a second structural support 36 is present as well in contact with the inner opening 34 to provide the same basic benefits and functions as the support structure 36 for the spherical grip portion 12, above. As such, the grip portion 12 and/or the weight portion 28 may be easily removed and replaced through the removal of either or both of the bolts 24, 38 from the target grip 12 and/or weight 28 portions on demand by the user. The preferable manner of attaching the replacement portions 12, 28 to the flexible rod 16 is through the same type of introduction of the rod ends 14, 30 through a properly configured, straight opening with the target grip portion and/or weight portion replacement, with the securing thereof by the same or similar bolts 24, 38. As noted from these drawings, the resultant device 10 is substantially configured along the axis of the flexible rod 16 with a certain level of sag allowed due to said flexibility of the extension rod 16 in relation to the weight of the grip portion 12 on one end 14 as well as the overall weight of the weight portion 28 on the second end 28, thereof. The overall length of the entire device is roughly 18 inches (roughly 45 centimeters) with a small amount of excess to the overall length of the rod 16 due to the outer peripheries of the bolts 24, 38 present and attached to the ends 14, 30 thereof. The user would grip the desired grip portion 12 (again, in this embedment a regulation size baseball) and make a throwing motion therewith while starting with the weight portion 28 present behind his or her back. The device would then be propelled through the arc created due to the centripetal force of the user's arm movements with the resultant reactive centrifugal force creating a degree of torque on the user's muscles as he or she carries through with the typical stride, delivery, and follow-through movements associated with the throwing motion itself (as shown in FIGS. 8A through 8D). The user would keep his or her grip on the grip portion 12 and the weight portion 28 would create a unique inertial sensation through such centrifugal forces such as to require the user to increase muscle contractions and stresses at certain locations in his or her shoulder, biceps, triceps, and forearms (if not wrists as well) to compensate for the exaggerated torque generated from such a device while in use. Repetitive motion in the same manner thus allows for continual muscle contractions, etc., so as to break down muscles in discrete areas of the arm and shoulder in order to eventually allow for muscle toning and build up in such previously unappreciated regions. FIGS. 2 through 7 provide various alternatives to the replacement portions 12, 28, in order to allow the user the ability to access different grips and different weight possibilities to further enhance such a workout regimen and further strengthen the overall arm and shoulder areas to levels heretofore unseen. The bolts 24, 38 are preferably recessed, however, within the grip 12 and weight 28 portions thereof to permit close simulation to an actual baseball or softball and to relieve any possible discomfort to the user as possible.

Figure 2:
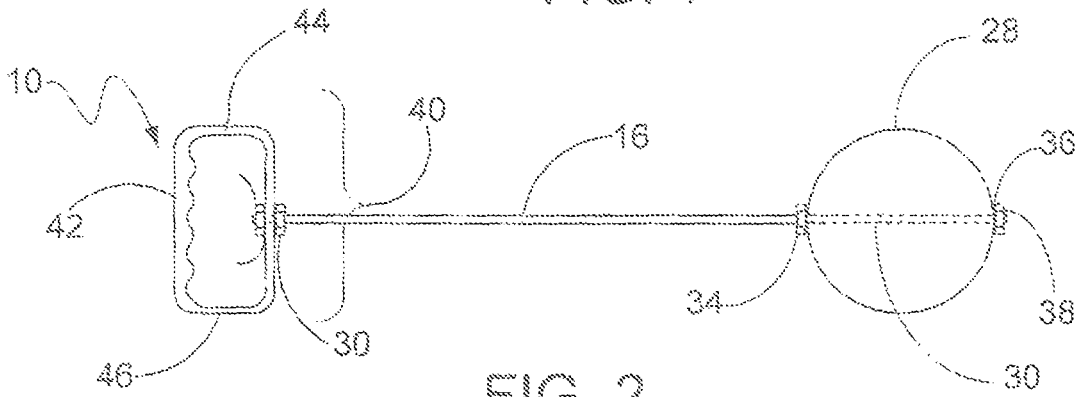
FIG. 2 is a side view of another embodiment of the inventive device utilizing an open grip handle portion.

FIG. 2 replaces the baseball grip portion (12 of FIG. 1) with a closed loop handle 40 that includes an outer portion 42, two parallel side portions 44, 46 and a bottom portion 48 to which the bolt 38 is attached to the end 30 of the rod 16. A proper opening 50 is provided within the bottom portion 48 for this purpose, thus creating a secure manner of attaching such a handle. As noted above, a handle that is attached as a racket grip simulator may be utilized as well in this manner, thus aligning with the axis of the flexible rod 16 and attaching thereto in a like manner. The handle 40 actually increases the overall length of the device 10A roughly 3 inches (about 7.6 centimeters) due to the attachment point of the bolt 38 at the bottom portion 50 thereof. In this manner, the user would undertake a similar motion as for the baseball grip (12 of FIG. 1; or alternatively, as alluded to above, for the softball grip, if desired) but without the same grip applied thereto. is a side view of another embodiment of the inventive device utilizing an open grip handle portion.

Figure 3:
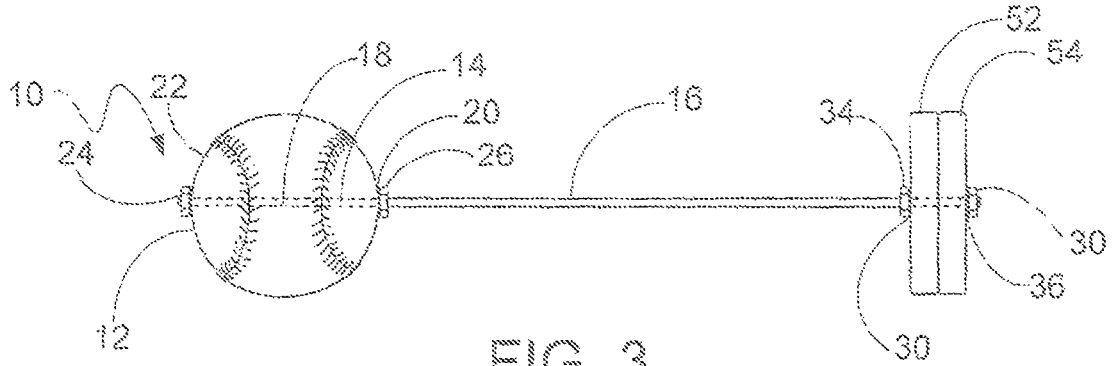
FIG. 3 is a side view of another embodiment of the inventive device of FIG. 1 utilizing a plurality of discs for the weight portion.

FIG. 3 thus replaces the spherical weight portion 28 of FIG. 1 with a plurality of weight discs 52, 54 instead. In this manner, the user may adjust the weight distribution from a spherical type (28 of FIG. 1) to such flat discs 52, 54 on demand. The bolt 30 would provide the necessary attachment to prevent unwanted disengagement therefrom.

As well, the support structure 34 would prevent unwanted movement toward the user during utilization thereof, thus permitting, if desired, free movement of such weight discs 52, 54 along the axis of the rod 16 within the space between the bolt 30 and the support structure 30, thus creating further inertial distortions and different torque results on the user's muscles. However, if a sufficient number of weight discs 52, 54 are present to fill the entire space between the bolt 24 (being present at the second end 42 of the rod 16) and the support structure 34, then a substantially non-moving weight portion with discs 52, 54 would be provided for yet another type of workout.

Figure 4:
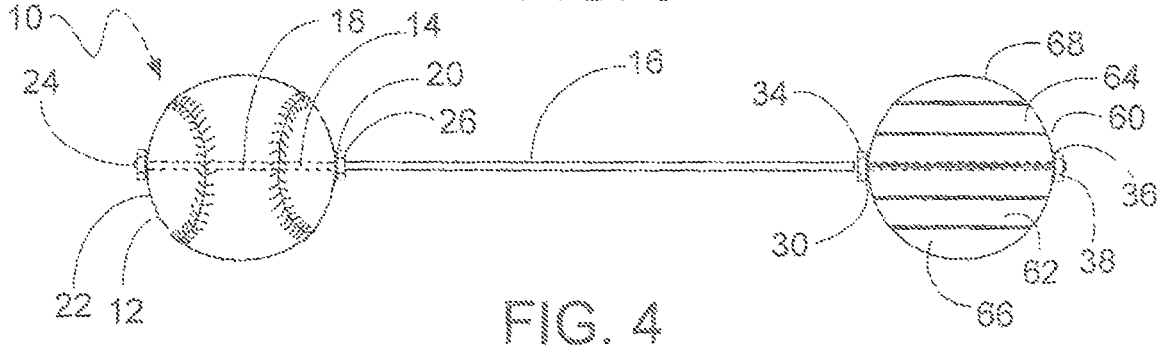
FIG. 4 is a side view of another embodiment of the inventive device of FIG. 1 utilizing a spherical weight portion having removable components for weight differentiation.

FIG. 4 provides yet another alternative to the weight portion (28 of FIG. 1, for instance) in that a spherical weight 58 may be attached as for the spherical weight portion of FIG. 1 (28), but with removable weight portions built therein 60, 62, 64, 66, 68. Thus, the spherical weight 58 has a base member 60 that is in essence a disc itself and through which the flexible rod 16 is introduced and the bolt 38 and the structure support 34 are present as for the spherical weight portion of FIG. 1 (28), and weighing approximately 12 ounces on its own, whereas uniform smaller discs 62, 64 fit above and below such a base 60 and weighing 10 ounces apiece, and attachable through any suitable means (here a strong magnet provides one potentially preferred manner of doing so) such that a user may employ throwing motions without disengaging such smaller discs 62, 64 from the base member 60 (for safety purposes, primarily). Even smaller weights 66, 68 that comport a top curved outline to form the spherical shape of the weight portion 58 upon attachment thereof to the smaller discs 62, 64 and weighing approximately 5 ounces apiece, may be attached in similar manner to provide a heavier weight portion 58 as well. In essence, it is possible to provide such weights that may include removable portions on demand for the user to experience differing degrees of torque during use, if desired. The removal such weight components 62, 64, 66, 68 may be performed with any components removed as desired by the user, thus allowing for non-uniform weights on either side of the axis of the flexible rod 16, thus, again, providing the user with a unique manner of toning muscles in various ways and to varying degrees.

Figure 5:
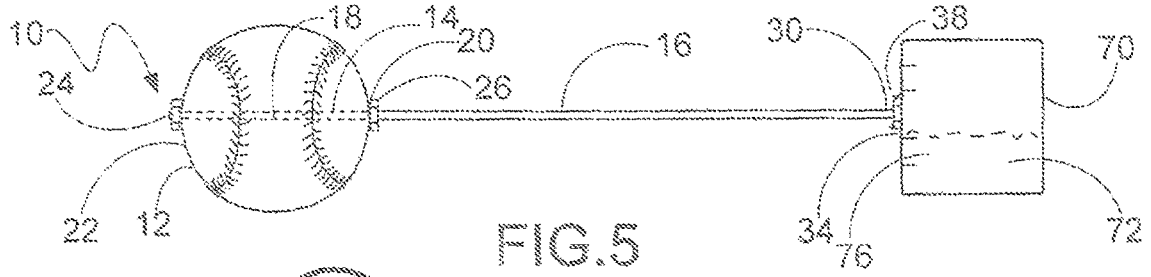
FIG. 5 is a side view of another embodiment of the inventive device of FIG. 1 utilizing a liquid holding component as the weight portion.

Another manner of supplying the user with different manners of creating torque on the arm and shoulder muscles is through the replacement of the weight portion (28 of FIG. 1) with a bottle 70 including any amount liquid 72 up to its capacity, as shown in FIG. 5. The flexible rod 16 may be introduced through the entire bottle 70, if desired with the bolt 28 attached outside thereof. A suitable rubber seal is present at each opening in the bottle 74, 76 through which the rod 16 enters and exits in order to reduce any leakage therefrom during use. The level of liquid 72 may be adjusted, as noted above, and thus may provide differing torque levels during utilization, if desired, by the user.

Figure 6:
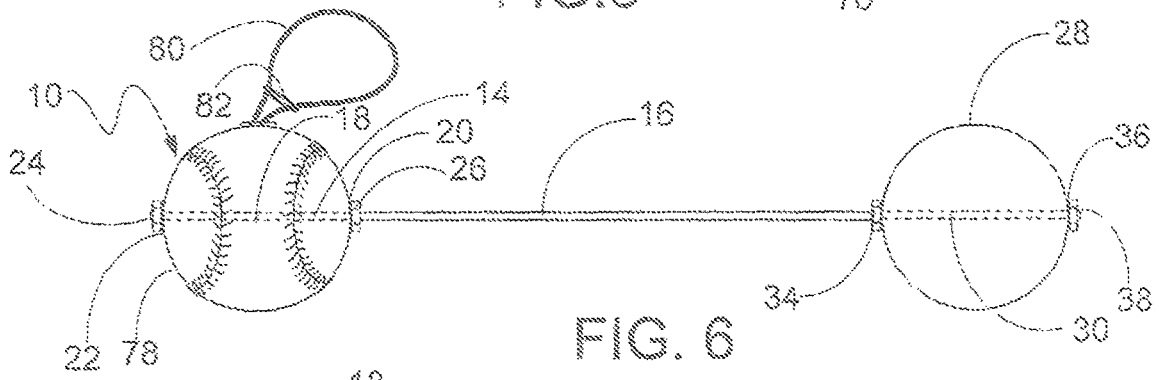
FIG. 6 is a side view of another embodiment of the inventive device of FIG. 1 utilizing a softball-shaped grip portion with a wrist attachment implement.

FIG. 6 shows yet another potentially preferred embodiment wherein the grip portion 78 (here a softball through which the rod 16 is introduced and attached as above) with a loop wrist attachment 80 to allow for safety measures to be in place in case the user loses his or her grip during actual use thereof. The attachment 80 allows for the user to enter his or her wrist therein and the to then slide the smaller enclosing loop 82 over the attachment 80 until the smaller loop 82 abuts the user's wrist (not illustrated). In this manner, the wrist attachment 80 substantially prevents the device from escaping the user's person, regardless if the user loses grip on the grip portion 78 itself during use.

Figure 7A:
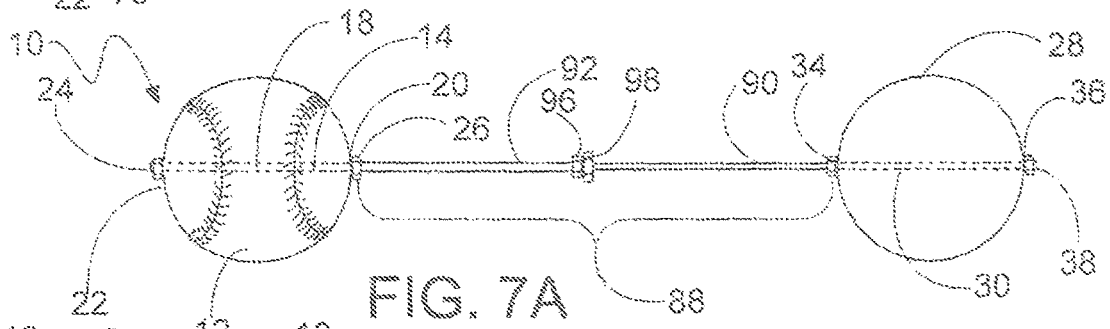
FIGS. 7A, 7B, and 7C provide side views of another embodiment of the inventive device of FIG. 1 utilizing a telescoping flexible rod portion to adjust the space lengths between the handle and weight portions on demand each in differing graduated extended lengths.
Figure 7B:
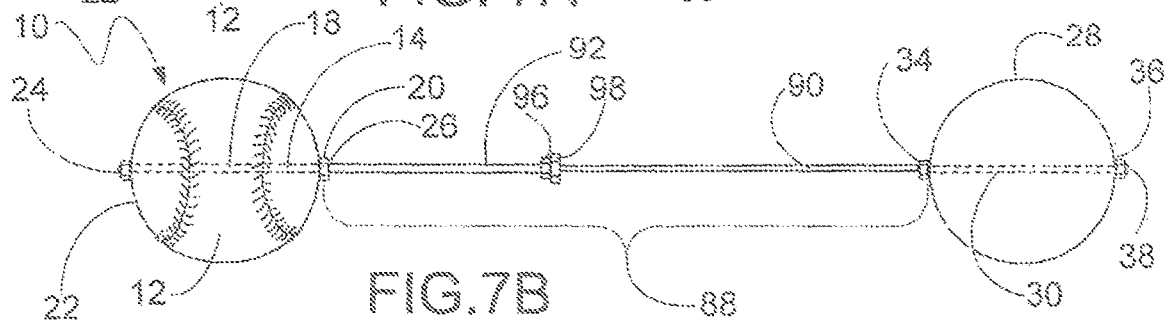
Figure 7C:
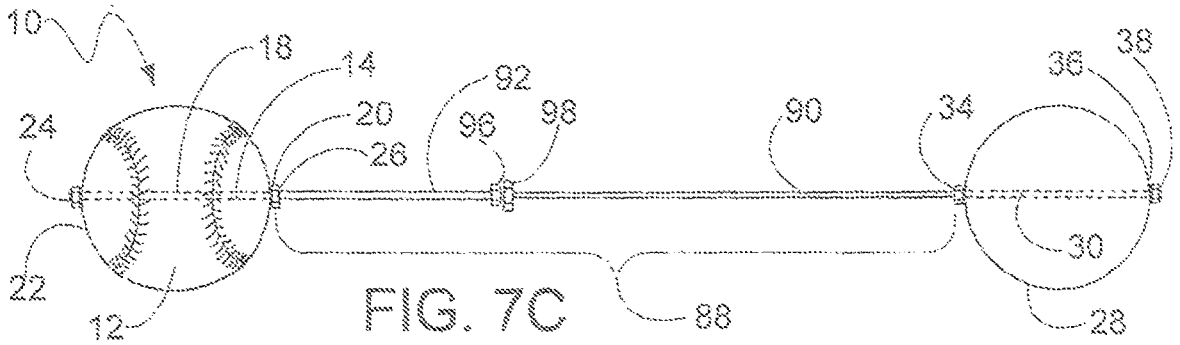
Figure 8A:
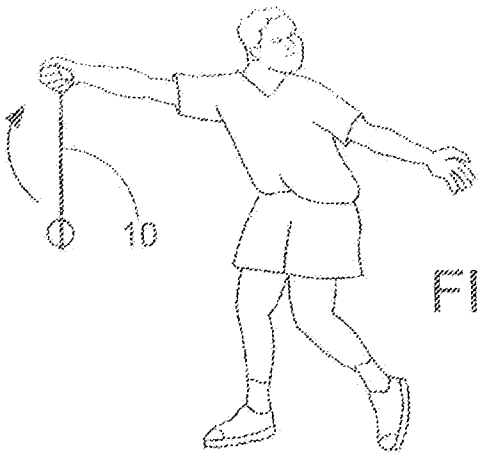
FIGS. 8A through D are diagrammatic perspective views of an athlete using the inventive device, showing various phases of a complete pitching motion which are, in order: the ready-position (8A), stride (8B), delivery (8C) and follow-through (8D).
Figure 8B:
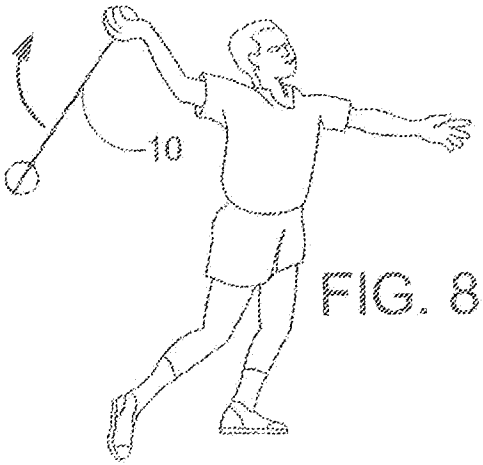
Figure 8C:
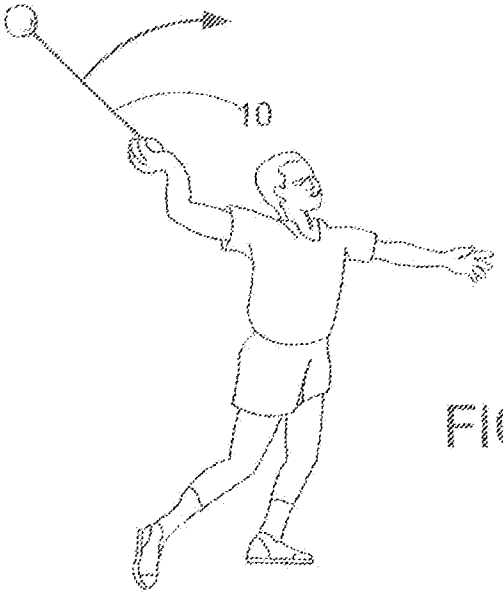
Figure 8D:
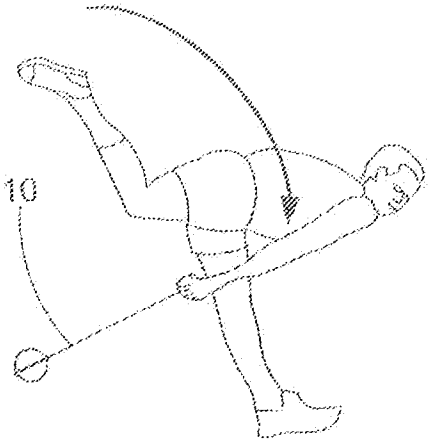

As noted above, the flexible rod 16 may be of any desired length between 10 inches (25.4 centimeters) and 3 feet (133 centimeters). The taller the user, presumably the greater length will be desired in order to accord the greater degree of centripetal force in relation to the user's arm length. Although multiple rods of differing lengths may be employed, thus allowing the user to interchange not only the grip and weight portions thereof, but the rod extension as well, FIGS. 7A through 7C provide another possible embodiment of the device of FIG. 1, but with a telescoping rod 88, rather than one with a set, permanent length. Such a rod 88 has two interlocking shafts configured with the narrower one 90 nested in slidable relation within the other 92. A compression nut 94 is present on the outside of the wider shaft that allows for tightening and releasing of thereof on demand by the user. The overall length of the fully opened telescoping rod 88 is a function of slightly less than twice the length of the narrower shaft 90. Here, for example, is a side view of another embodiment of the inventive device of FIG. 1 utilizing a telescoping flexible rod portion to adjust the space lengths between the handle and weight portions on demand. Thus, FIG. 7A shows the rod 88 at its shortest length with the narrower shaft 90 fully nested within the wider shaft 92 and the compression nut 94 tightened in place so as not to allow the rod 88 to extend during use. FIG. 7B shows the narrower shaft 90 partially nested at roughly the mid-point of the greatest distance at which the rod 88 may extend in such a manner; FIG. 7C shows the furthest extent the rod 88 may extend. An internal end cap (not illustrated) is present on the outer end of the narrower shaft 90 present within the wider shaft 92 and of a shape and size that prevents the narrower shaft 90 from escaping the wider shaft 92 at any time (unless the user actually destroys the rod 88 itself). The wider shaft 92 includes a metal cap 96 on its internal end 98 that runs the periphery of the internal end 98 and is the proper shape and size to prevent the internal cap (not illustrated) of the narrower shaft 90 to pass (as noted above). Thus, if desired, the user may actually disengage the compression nut 94 if desired to allow for free movement of the rod 88 in telescoping motion to provide yet another manner of throwing motion with a vastly different result from any prior device.

FIGS. 8A through D are diagrammatic perspective views of an athlete using the inventive device of FIG. 1 (and correlating to all such devices discussed herein), showing various phases of a complete pitching motion which are, in order: the ready-position (8A), stride (8B), delivery (8C) and follow-through (8D).

An advantage of this invention is that the device does not require anyone other than the athlete to use. The device need not be tethered, anchored or fixed to any grounding structure. It is wholly hand-held, easily portable and useable either indoors or outdoors. On a pitching mound, the device allows an athlete to train under the same conditions as would be experienced in a game, thereby maximizing the development of muscular strength and coordination at "game speed". The device remains in the athlete's hand during use thereby allowing a fast-paced, repetitive oscillating workout uninterrupted by having to stop for repeated thrown ball retrievals. Indoors, an athlete may use the device before a mirror or other reflective surface for better evaluating and rapidly correcting flaws in pitching technique.

The device can be used to warm-up an athlete's throwing arm and/or rehabilitate it with moderate effort. An athlete using this device can generate less acceleration on various elements of his/her muscular-skeletal structure to produce a lower impact workout, including one with a gradual, more benign deceleration than is typical in pitching a baseball. As such, use of this device should minimize or completely eliminate those shoulder and arm injuries normally associated with rapid deceleration by a fatigued athlete.

It is understood that the training and strengthening device of this invention can be employed for other training uses including throwing a football, a softball and/or serving a tennis ball. In some cases, alternative uses of the device may necessitate, or result in, changes to the embodiments described above. But all such changes are considered to be still within the scope of the present invention.

What is claimed is:

1. An athletic training device comprising: 1) a spherical hand-held grip portion of a regulation-size baseball or regulation-size softball to allow a user to properly handle such a grip portion and implement a throwing motion of the entire training device without releasing such a grip portion after such throwing motion has completed; 2) a weight portion, said weight portion selected from the group consisting of a spherically shaped implement, a liquid container, at least one attachable disc, and any combination thereof; and 3) a substantially straight flexible rod portion having a first end and a second end, wherein said first end of said substantially straight flexible rod portion is attached to said hand-held grip portion and said second end of said substantially straight flexible rod portion is attached to said weight portion, and wherein said flexible rod exhibits a length of from 10 inches (25.4 cm) to 4 feet (121.92 cm).

2. The athletic training device of claim 1 wherein said substantially straight flexible rod portion includes means for securely and releasably retaining said spherical hand-held grip portion thereto at said first end.

3. The athletic training device of claim 1 wherein said weight portion is a spherically shaped implement.

* * * * *